US010980326B2

(12) United States Patent
Pang

(10) Patent No.: US 10,980,326 B2
(45) Date of Patent: Apr. 20, 2021

(54) HAIR STRAIGHTENER

(71) Applicant: KONINKLIJKE PHILIPS N.V., Eindhoven (NL)

(72) Inventor: Chuen Yu Cyrus Pang, Fanling N.T. (HK)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/733,069

(22) PCT Filed: Jan. 29, 2019

(86) PCT No.: PCT/EP2019/052028
§ 371 (c)(1),
(2) Date: May 7, 2020

(87) PCT Pub. No.: WO2019/154662
PCT Pub. Date: Aug. 15, 2019

(65) Prior Publication Data

US 2020/0352302 A1 Nov. 12, 2020

(30) Foreign Application Priority Data

Feb. 9, 2018 (EP) ..... 18156070

(51) Int. Cl.
*A45D 1/00* (2006.01)
*A45D 1/04* (2006.01)
(Continued)

(52) U.S. Cl.
CPC ..... *A45D 1/04* (2013.01); *A45D 1/28* (2013.01); *A45D 2/001* (2013.01)

(58) Field of Classification Search
CPC ... A45D 1/00; A45D 1/04; A45D 1/06; A45D 1/08; A45D 1/14; A45D 1/28; A45D 2/001
See application file for complete search history.

(56) References Cited

U.S. PATENT DOCUMENTS

2005/0155620 A1 7/2005 Gold
2010/0147323 A1* 6/2010 Hafemann ..... A45D 1/04 132/223
(Continued)

FOREIGN PATENT DOCUMENTS

EP 1721539 11/2006
EP 1733642 12/2006
(Continued)

OTHER PUBLICATIONS

International Search Report and Written Opinion dated Mar. 21, 2019 for International Application No. PCT/EP2019/052028 Filed Jan. 29, 2019.

*Primary Examiner* — Rachel R Steitz

(57) ABSTRACT

A hair straightener (HS) comprises a heating unit (HU) for heating hair while exercising a pressure on the hair, a temperature sensor (TS) for measuring a temperature of the heated hair to obtain a measured temperature, and a pressure adjustment unit (PAU) for adjusting the pressure exercised by the heating unit (HU) on the hair, in dependence on the measured temperature. The heating unit (HU) may comprise a pair of heating plates (HP1, HP2) between which hair is clamped, and the pressure adjustment unit (PAU) may be arranged for changing a distance between the heating plates (HP1, HP2). The pressure adjustment unit (PAU) may comprise a motor-operated push tool (W, C) for increasing the distance between the heating plates (HP1, HP2) when the measured temperature exceeds a first threshold temperature. The hair straightener (HS) may comprise a pair of hinged arms (A1, A2) each provided with a respective one of the heating plates (HP1, HP2). The pressure adjustment unit (PAU) may comprise a motor-operated pull tool (W, S), for decreasing a distance between the hinged arms (A1, A2) when the measured temperature falls below a second thresh-
(Continued)

old temperature, whereby the distance between the heating plates (HP1, HP2) is reduced.

7 Claims, 1 Drawing Sheet

(51) Int. Cl.
*A45D 1/28* (2006.01)
*A45D 2/00* (2006.01)

(56) References Cited

U.S. PATENT DOCUMENTS

| | | | | |
|---|---|---|---|---|
| 2010/0206321 | A1 | 8/2010 | Takehana | |
| 2012/0055501 | A1 | 3/2012 | Seng | |
| 2012/0080047 | A1 | 4/2012 | Glucksman | |
| 2015/0173480 | A1* | 6/2015 | Washington | A45D 2/367<br>132/206 |
| 2015/0335121 | A1 | 11/2015 | Floessholzer | |
| 2016/0213117 | A1* | 7/2016 | Keong | A45D 1/28 |

FOREIGN PATENT DOCUMENTS

| | | | |
|---|---|---|---|
| WO | 2014/001128 | | 1/2014 |
| WO | WO 2017089152 | * | 6/2017 |

* cited by examiner

HAIR STRAIGHTENER

CROSS REFERENCE TO RELATED APPLICATIONS

This application is the U.S. National Phase application under 35 U.S.C. § 371 of International Application No. PCT/EP2019/052028 filed Jan. 29, 2019, published as WO 2019/154662 on Aug. 15, 2019, which claims the benefit of European Patent Application Number 18156070.7 filed Feb. 9, 2018. These applications are hereby incorporated by reference herein.

FIELD OF THE INVENTION

The invention relates to a hair straightener.

BACKGROUND OF THE INVENTION

WO2014001128 discloses a hair straightener with two legs, which has a grip region and a heatable operating region. A detection device is provided which detects that the hair straightener is being used and communicates this information to a corresponding control/regulating device, the control/regulating device being designed so as to activate a heating device to heat the operating region upon reception of a corresponding signal. The detection device may be a pressure switch to record the closing of the two legs.

US2012080047 discloses a hair straightening tool that is comb-like. The straightening tool has a row of tines that are spaced apart respectively to each other by one hair receptacle. Each tine is associated with at least one first molded part that is movably mounted. It is movably supported relative to the additional tine that surrounds the hair receptacle. The straightening tool furthermore surrounds a second molded part which is associated with the additional tine that surrounds this hair receptacle. This serves the implementation of a hair shaping gap between the molded parts of a hair receptacle. It is viewed as sufficient if only one of the two molded parts is heated. This tool is based on a prior art device which already shows that a spring force that is acting on the individual first molded parts determines that force that acts on the hair for the process of the straightening. The second molded part then represents the abutment. EP1721539 shows that it is possible to adjust the spring force by means of a set screw, and thereby the force that is acting on the hairs for the process of the hair straightening.

A typical hair straightener uses temperature sensors to detect a change of a heating plate temperature, and compensate for any heat loss due to heating the hair by increasing the heater's temperature, or when the heating plate temperature is too high, it turns off the power to the heater until the temperature falls within the target range again. There are a few disadvantages of this kind of control. First is the fact that the heating plate temperature does not nearly reflect the hair temperature. The hair temperature can be greatly affected by the contact pressure and the stroke speed. Second is the time delay between when the heating plate temperature changes, and when the sensor starts responding to that change. A typical delay is at least five seconds. Third is the time delay between when the heater starts reacting and when the heating plate temperature starts changing. For example, when the temperature sensor senses that the heating plate temperature is too low, it sends a signal to power up the heater. After the heater is turned up, it will take a few seconds before the heating plate temperature starts to go up. And it will take another few seconds before the heating plate will reach its target temperature. A straightening stroke would have ended before the heating plate's temperature starts changing let alone affecting the hair temperature in a desired way.

SUMMARY OF THE INVENTION

It is, inter alia, an object of the invention to provide an improved hair straightener. The invention is defined by the independent claims. Advantageous embodiments are defined in the dependent claims.

One aspect of the invention provides a hair straightener comprises a heating unit for heating hair while exercising a pressure on the hair, a temperature sensor for measuring a temperature of the heated hair to obtain a measured temperature, and a pressure adjustment unit for adjusting the pressure exercised by the heating unit on the hair in dependence on the measured temperature. The heating unit may comprise a pair of heating plates between which hair is clamped, and the pressure adjustment unit may comprise a tool for changing a distance between the heating plates. The pressure adjustment unit may comprise a motor-operated push tool for increasing a distance between the heating plates when the measured temperature exceeds a first threshold temperature. The hair straightener may comprise a pair of hinged arms each provided with a respective one of the heating plates. The pressure adjustment unit may comprise a motor-operated pull tool, for reducing a distance between the hinged arms when the measured temperature falls below a second threshold temperature, whereby the distance between the heating plates is reduced. The motor-operated pull tool may be coupled to the second arm and may comprise a spring for generating a first pull force substantially parallel to the first arm, and a force translation tool coupled to the first arm for translating the first pull force substantially parallel to the first arm into a second pull force substantially perpendicular to the first arm, to decrease the distance between the heating plates when the measured temperature falls below a second threshold temperature.

Advantageously, the use of pressure adjustment mechanism can instantly affect the heat transfer from the heating unit onto the hair, without needing to wait for the heating unit to slowly change its temperature.

These and other aspects of the invention will be apparent from and elucidated with reference to the embodiments described hereinafter.

DESCRIPTION OF EMBODIMENTS

Figure 1:
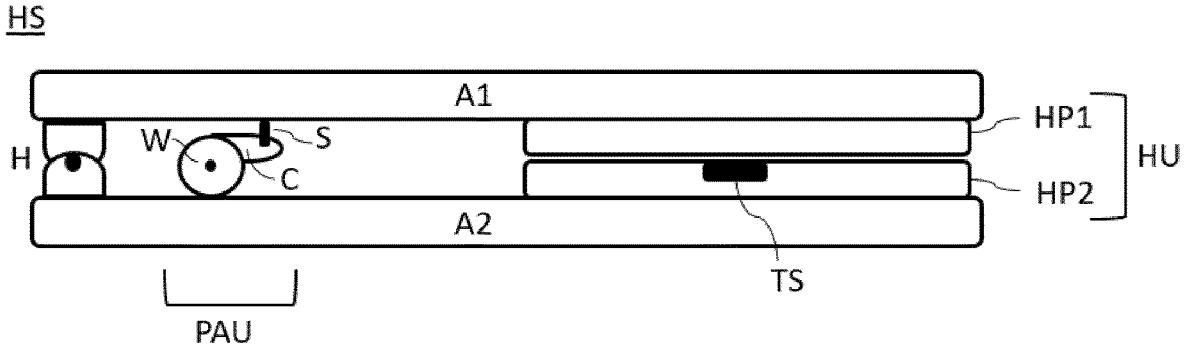
FIG. 1 shows an embodiment of a hair straightener according to the present invention.

A hair straightener relies on physical contact between its heating plates and hair to transfer energy onto the hair to achieve straightening effect. Usually the higher the pressure between the heating plates and the hair, the better the straightening effect. However, when the pressure is too high, the friction between the heating plates and the hair will increase, the speed of the straightening stroke will decrease, and the heat transfer from the heating plates onto the hair will increase significantly both from the higher pressure and from the longer contacting time.

An infrared sensor can be used to detect the hair temperature after it is pressed by the heating plates, and determine whether it is higher than expected which might induce permanent hair damage, or lower than expected which might affect the straightening result. On each temperature setting the user selected, there should be an expected hair temperature outcome. By comparing the data collected from the infrared temperature sensor and the expected values for each temperature setting, the internal processor would know whether the heat transfer is normal, too high or too low. The use of infrared sensor to measure hair temperature directly can greatly reduce the approximation between heating plate temperature and hair temperature, also it is a much faster sensor compared to typical NTC temperature sensor used in hair straighteners.

One of the most direct ways to alter the heat transfer between the heating plates and the hair is by changing the contact pressure. The contact pressure normally is completely controlled by the user. However, mechanisms can be added to either augment to that pressure or detract from that pressure during a straightening stroke. When the actual hair temperature is measured to be too high, the mechanism should reduce the contact pressure currently being applied by the user to reduce the heat input onto the hair to prevent heat damage. Similarly, when the actual hair temperature is measured to be too low, the mechanism should increase the contact pressure currently being applied by the user to increase the heat input onto the hair to improve the straightening result.

The pressure adjustment mechanism can work progressively, meaning that if the hair temperature is only a little out of range, the pressure adjustment can be small. Versus if the hair temperature is very far from the expected temperature range, the pressure adjustment mechanism can turn on full power to increase or reduce the contact pressure to the maximum or minimum.

An embodiment of the invention provides a hair straightener with a least one infrared sensor that senses the actual hair temperature coming out from the hair straightener. During a straightening stroke, the hair is pressed between the heating plates with a certain pressure exerted by the user. When the temperature of the hair at the exit exceeds a certain value, the built in pressure adjustment mechanism will reduce the exerted pressure, in turn reduce the heat transfer from the heating plates onto the hair, thus preventing or reducing heat damage. Similarly, when the hair temperature is less than a certain value, the pressure adjustment mechanism will increase the exerted pressure; in turn increase the heat transfer from the heating plate onto the hair, thus improving the straightening effect.

An embodiment of this invention provides a hair straightener with two arms, at least one infrared temperature sensor, two heating plates for applying pressure onto hair, a hinge, and a mechanism for applying additional or reducing contact pressure onto the hair or from the hair. The infrared sensor can be mounted on the side of the straightener, facing in the direction where the hair exits between the upper and lower heating plates. The contact pressure adjustment mechanism can be mounted at the spring-loaded hinge as a geared design driven by a stepper motor with angular position encoder. During normal usage, the motor is not energized, thus the two arms are free to open and close without any disruption from the mechanism even when the gears are always meshed. In a stroke when the user is exerting a constant pressure on the two arms and when the exit hair temperature is too cold compared to an expected value, the motor will rotate certain degrees clockwise as shown the diagram, the upper arm will in turn be forced to press down from its current position, augmenting to the constant pressure being applied by the user, thus increasing the total contact pressure between the heating plates and the hair. This mechanism can work the other way around when the hair contact pressure needs to be reduced, the motor can turn counter clockwise by certain degrees to achieve this result. This pressure adjusting mechanism can be all housed inside the housing of the straightener body.

FIG. 1 shows an embodiment of a hair straightener HS according to the present invention. The hair straightener HS comprises two arms A1, A2 coupled via a hinge H. Each arm A1, A2 is provided with a respective heating plate HP1, HP2, which together form a heating unit HU. A temperature sensor TS measures a temperature of the heated hair to obtain a measured temperature. A pressure adjustment unit PAU is provided for adjusting a pressure at which the heating plates HP1, HP2 are pressed against the hair between the heating plates HP1, HP2 in dependence on the measured temperature.

In the embodiment of FIG. 1, the pressure adjustment unit PAU comprises a wheel W mounted on and operated by a servo-motor (not shown), which is mounted on the second arm A2. The wheel W is provided with a cam C, together forming a push tool for increasing the distance between the heating plates (HP1, HP2) when the measured temperature exceeds a first threshold temperature. A spring S is mounted between the first arm A1 and the cam C on the wheel W, the wheel W and spring S together forming a pull tool to decrease the distance between the heating plates when the measured temperature falls below a second threshold temperature.

If the measured hair temperature is too low, the servo-motor is controlled by the temperature sensor TS to make the wheel W turn clockwise. This will make the first arm A1 to be pulled downwards by the spring S. This will increase the pressure exercised by the heating plates H1, H2 on the hair between the heating plates H1, H2.

If the measured hair temperature is too high, the servo-motor is controlled by the temperature sensor TS to make the wheel W turn counter-clockwise. This will make the first arm A1 to be pushed upwards by the cam C that is mounted on the wheel W. This will decrease the pressure exercised by the heating plates H1, H2 on the hair between the heating plates H1, H2.

Figure 2:
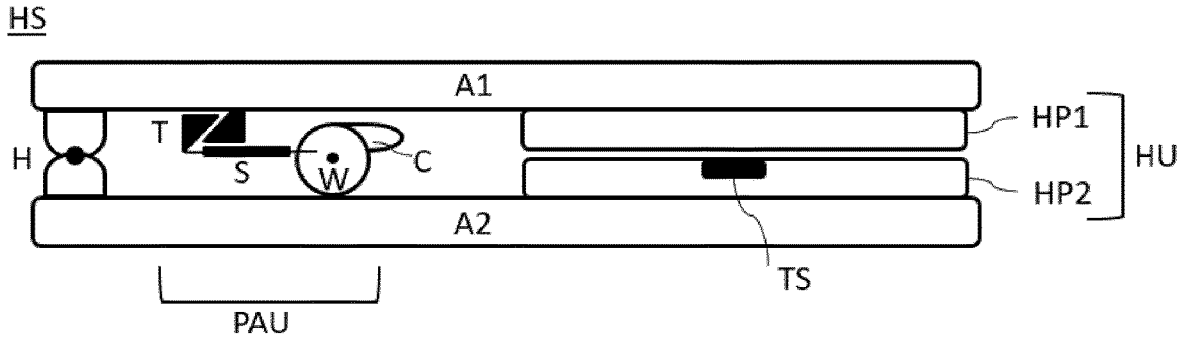
FIG. 2 shows another embodiment of a hair straightener according to the present invention.

FIG. 2 shows another embodiment of a hair straightener HS according to the present invention. FIG. 2 differs from FIG. 1 in that the pressure adjustment unit PAU now comprises a force translation tool T formed by a pair of triangles, one triangle (the left triangle in FIG. 2) being connected to the spring S, and another triangle (the right triangle in FIG. 2) being connected to the first arm A1. If the measured hair temperature is too low, and the wheel W is made to turn clockwise, the spring S will pull the left triangle to the right, and the left triangle will pull the first arm A1 downwards as the slanted edges of the triangles will translate the horizontal force of the left triangle being pulled against the right triangle into a vertical force. Instead of a pair of triangles, the force translation tool T may comprise a pair of other shapes that have matching slanted edges to translate a force in a first direction into a force in a second direction that is substantially perpendicular to the first direction.

It should be noted that the above-mentioned embodiments illustrate rather than limit the invention, and that those skilled in the art will be able to design many alternative embodiments without departing from the scope of the appended claims. The heating unit may heat the hair by means of heated heating plates, or by means of applying light or ultrasound to the hair. The pressure adjustment unit may alternatively use a piston between the heating plates, to which air is applied if the distance between the heating plates needs to be increased, and from which air is drawn if the distance between the heating plates needs to be decreased. The pressure adjustment unit could alternatively change the angle between the two arms because they are pivoted at one point. The pressure adjustment unit could alternatively change the pressure or the force between the heating plate and the hair without changing the distance between the heating plates, because when the heating plate are tightly pressed together, the heat transfer is high. And when the plates are lightly touching, the heat transfer is low, but in both cases, the distance is zero. The hair straightener may have two heating plates which are pressed together by a user, or may be a comb-like device as described in US20120080047. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements, and/or by means of a suitably programmed processor. In the device claim enumerating several means, several of these means may be embodied by one and the same item of hardware. The mere fact that certain measures are recited in mutually different dependent claims that do not refer to one another does not indicate that a combination of these measures cannot be used to advantage.

The invention claimed is:

1. A hair straightener comprising:
a heating unit configured to:
heat hair while exercising a pressure on said hair;
a temperature sensor configured to:
measure a temperature of the heated hair to obtain a measured temperature; and
a pressure adjustment unit configured to:
adjust a pressure exercised by the heating unit on the hair in dependence on the measured temperature;
wherein the heating unit comprises a pair of heating plates between which hair is clamped,
wherein the pressure adjustment unit is arranged for changing a distance between the heating plates in dependence on the measured temperature; and comprises a motor-operated push tool configured to increase the distance between the heating plates when the measured temperature exceeds a first threshold temperature.

2. A hair straightener comprising:
a heating unit configured to:
heat hair while exercising a pressure on said hair;
a temperature sensor configured to:
measure a temperature of the heated hair to obtain a measured temperature; and
a pressure adjustment unit configured to:
adjust a pressure exercised by the heating unit on the
hair in dependence on the measured-temperature
wherein the heating unit comprises a pair of heating plates between which hair is clamped,
wherein the pressure adjustment unit is arranged for changing a
distance between the heating plates in dependence on the measured temperature;
wherein the hair straightener further comprises a pair of hinged arms each provided with a respective one of the heating plates, and
the pressure adjustment unit comprises a motor-operated pull tool configured to decrease a distance between the hinged arms when the measured temperature falls below a second threshold temperature, whereby the distance between the heating plates is reduced.

3. The hair straightener as claimed in claim 2, wherein the motor-operated pull tool is coupled to a second arm and comprises:
a spring configured to:
generate a first pull force substantially parallel to the first arm, and
a force translation tool coupled to the first arm for translating the first pull force substantially parallel to the first arm into a second pull force substantially perpendicular to the first arm, to decrease the distance between the heating plates when the measured temperature falls below the second threshold temperature.

4. A hair straightener comprising:
a first arm; and
a second arm, said first arm and said second arm connected at a first end, at least one of said first arm and said second arm comprising:
a heating plate;
a motor-operated push tool;
a heating unit configured to:
heat said heating plate associated with one of said first arm and said second arm, wherein said heating plate is configured to:
heat a hair captured between said first arm and said second arm;
a temperature sensor configured to:
measure a temperature of the hair heated by said heating plate; and
a pressure adjustment unit configured to:
receive the measured temperature of the hair; and
alter a distance between the heating plates in dependence on the measured temperature, wherein said distance is increased when the measured temperature exceeds a first threshold temperature and said distance decreases when said measured temperature fails below a second threshold.

5. The hair straightener as claimed in claim 4, wherein the motor-operated pull tool comprises:
a spring configured to:
generate a first pull force substantially parallel to said first arm, and
a force translation tool coupled to the first arm, said translation tool configured to:
translate the first pull force into a second pull force, wherein said second pull force is substantially perpendicular to the first arm.

6. A hair straightener comprising:
a heating unit comprising:
a pair of heating plates between which hair is clamped
a temperature sensor; and
a pressure adjustment unit comprising;
a motor configured to:
change a distance between the heating plates in dependence on a temperature measured by the temperature sensor, said distance between the heating plates increased when the temperature measured by the temperature sensor exceeds a first threshold temperature and deceased when the temperature measured by the temperature sensor falls below a second threshold temperature.

7. The hair straightener as claimed in claim 6 wherein the motor is coupled to a second arm of said hair straightener and comprises:

a spring configured to:

generate a first pull force substantially parallel to a first arm of said hair straightener, and a force translation tool coupled to the first arm configured to:

translate the first pull force substantially parallel to the first arm into a second pull force substantially perpendicular to the first arm.

* * * * *